United States Patent [19]

Liu et al.

[11] Patent Number: 5,006,308

[45] Date of Patent: Apr. 9, 1991

[54] NICKEL ALUMINIDE ALLOY FOR HIGH TEMPERATURE STRUCTURAL USE

[75] Inventors: Chain T. Liu, Oak Ridge; Vinod K. Sikka, Clinton, both of Tenn.

[73] Assignee: Martin Marietta Energy Systems, Inc., Oak Ridge, Tenn.

[21] Appl. No.: 364,774

[22] Filed: Jun. 9, 1989

[51] Int. Cl.[5] ..... C22C 19/05

[52] U.S. Cl. ..... 420/445; 148/428; 420/449

[58] Field of Search ..... 420/445, 449; 148/428

[56] References Cited

U.S. PATENT DOCUMENTS

| | | | |
|---|---|---|---|
| 4,612,165 | 9/1986 | Liu et al. | 420/459 |
| 4,711,761 | 12/1987 | Liu et al. | 420/459 |
| 4,722,828 | 2/1988 | Liu | 420/455 |
| 4,731,221 | 3/1988 | Liu | 420/445 |

FOREIGN PATENT DOCUMENTS 2037322A 7/1980 United Kingdom .

OTHER PUBLICATIONS

C. T. Liu, "Development of Nickel and Nickel-Iron Aluminides for Elevated-Temperature Structural Use," American Soc. for Testing and Materials, Special Technical Publication 979 (1988).

C. T. Liu et al., "Nickel Aluminides for Structural Use," Journal of Metals, vol. 38, No. 5, May 1986, pp. 19-21.

*Primary Examiner*—R. Dean

*Attorney, Agent, or Firm*—J. D. Griffin; Bruce M. Winchell

[57] ABSTRACT

The specification discloses nickel aluminide alloys including nickel, aluminum, chromium, zirconium and boron wherein the concentration of zirconium is maintained in the range of from about 0.05 to about 0.35 atomic percent to improve the ductility, strength and fabricability of the alloys at 1200° C. Titanium may be added in an amount equal to about 0.2 to about 0.5 atomic percent to improve the mechanical properties of the alloys and the addition of a small amount of carbon further improves hot fabricability.

17 Claims, 3 Drawing Sheets

Fig. 2

NICKEL ALUMINIDE ALLOY FOR HIGH TEMPERATURE STRUCTURAL USE

Figure 1A:
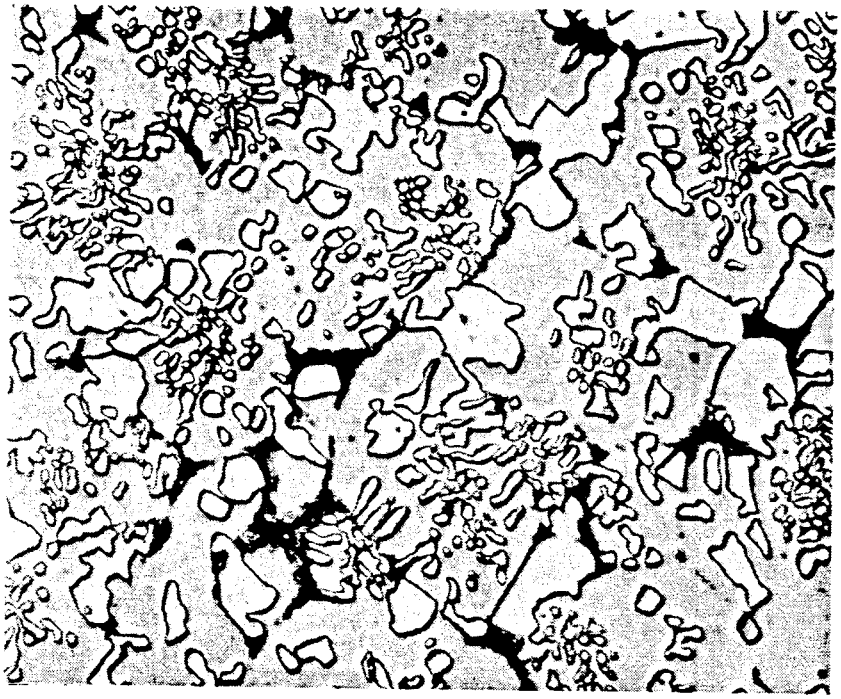

The U.S. Government has rights in this invention pursuant to Contract No. DE-AC05-840R21400 awarded by U.S. Department Energy contract with Martin Marietta Energy Systems, Inc.

The present invention relates to high temperature fabricable nickel aluminide alloys containing nickel, aluminum, boron and zirconium, and in some species, titanium or carbon.

Intermetallic alloys based on tri-nickel aluminide ($Ni_3Al$) have unique properties that make them attractive for structural applications at elevated temperatures. The alloys exhibit the unusual mechanical characteristic of increasing yield stress with increasing temperature whereas in conventional alloys yield stress decreases with temperature.

It is known from commonly assigned U.S. Pat. No. 4,711,761 entitled "Ductile Aluminide Alloys for High Temperature Applications" that this intermetallic composition exhibits increased yield strength upon the addition of iron, increased ductility upon the addition of boron, and improved cold fabricability upon the addition of titanium, manganese and niobium. Another improvement has been made in the base nickel aluminide by adding, in addition to iron and boron, hafnium and zirconium for increased strength at higher temperatures as disclosed in commonly assigned U.S. Pat. No. 4,612,165 entitled "Ductile Aluminide Alloys for High Temperature Applications." The above patents are incorporated herein by reference.

One of the primary problems encountered in utilizing the improved alloys was that they exhibited low ductility at high-temperatures. Since the strength of the alloys increased with increasing temperature, and since industrial processing normally involves working the alloys at high temperatures, problems arose in fabricating the alloys to desired shapes using customary foundry practices. This problem was overcome, to a degree, by holding the iron content high (in the neighborhood of 16 wt. %) and making minor changes in other constituents as disclosed in commonly assigned U.S. Pat. No. 4,722,828 entitled "High-Temperature Fabricable Nickel-Iron Aluminides." However, the high-iron content alloys as well as the alloys containing no iron were found to be subject to embrittlement when worked at elevated temperatures in an oxygen bearing environment. In commonly assigned U.S. Patent No. 4,731,221 entitled "Nickel Aluminides and Nickel-Iron Aluminides for Use in Oxidizing Environments," it is disclosed that the addition of up to about 8 at. % chromium would minimize the oxidation embrittlement problem.

Despite the above and other improvements in the properties of aluminide alloys, there still remain problems in preparing and using the alloys at temperatures above 1100° C. For example, the prior art high temperature fabricable alloys have contained iron, the element which lowers strength at high temperatures. It is, therefore, desirable to fabricate iron-free aluminide compositions which exhibit good fabricability properties at elevated temperatures. Furthermore, it has been found that when heating the prior art alloys containing zirconium (a known constituent for improving strength at high temperatures) an eutectic of zirconium-rich composition is produced at the grain interfaces if the rate of heating between 1150° C. and 1200° C. is too rapid, substantially reducing the high temperature strength and ductility of the alloy.

It is, therefore, an object of the present invention to provide nickel aluminide alloy compositions which are suitable for fabrication at high temperatures in the range of from about 1100 to about 1200° C.

An additional object of the invention is to provide a nickel aluminide alloy exhibiting improved fabricability, ductility, and strength at elevated temperatures in the area of 1200° C.

Still another object of the invention is the provision of high temperature fabricable nickel aluminide alloys which are not subject to significant corrosion by oxidation when exposed to an air environment at high temperatures in the range of 1100° to 1200° C.

The foregoing and other objects and advantages are achieved in accordance with the present invention which, in general, provides a nickel aluminide alloy comprising nickel and, in atomic percent, from about 15.5 to about 18.5% aluminum, from about 6 to about 10% chromium, from about 0.05 to about 0.35% zirconium and from about 0.08% to about 0.3% boron. The resulting alloys wherein zirconium is maintained within the range of from about 0.05 to about 0.35 atomic percent exhibit improved strength, ductility and fabricability at elevated temperatures in the range of from about 1100° to about 1200° C. which are the temperatures typically encountered in hot working processes such as hot forging, hot extruding and hot rolling. The addition of titanium in the range of from about 0.2 to about 0.5 at. % further improves the mechanical properties of the alloys. Also, the addition of about 0.5 at. % carbon improves the hot fabricability of the alloys. A particularly preferred aluminide composition falling within the ranges set forth for the alloy of the present invention contains, in atomic percent, 17.1% aluminum, 8% chromium, 0.25% zirconium, 0.25% titanium, 0.1% boron and a balance of nickel.

Figure 1B:
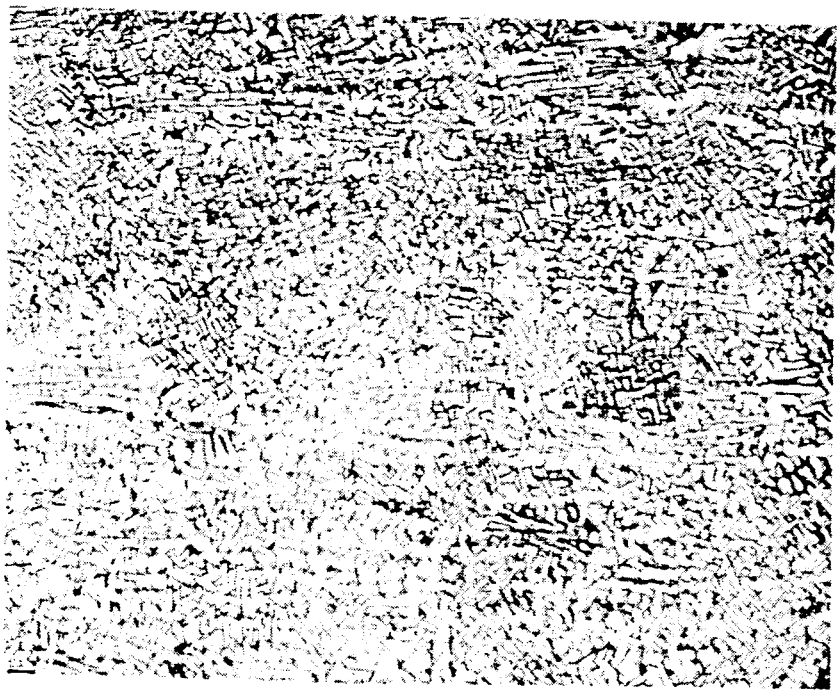
Figure 2:
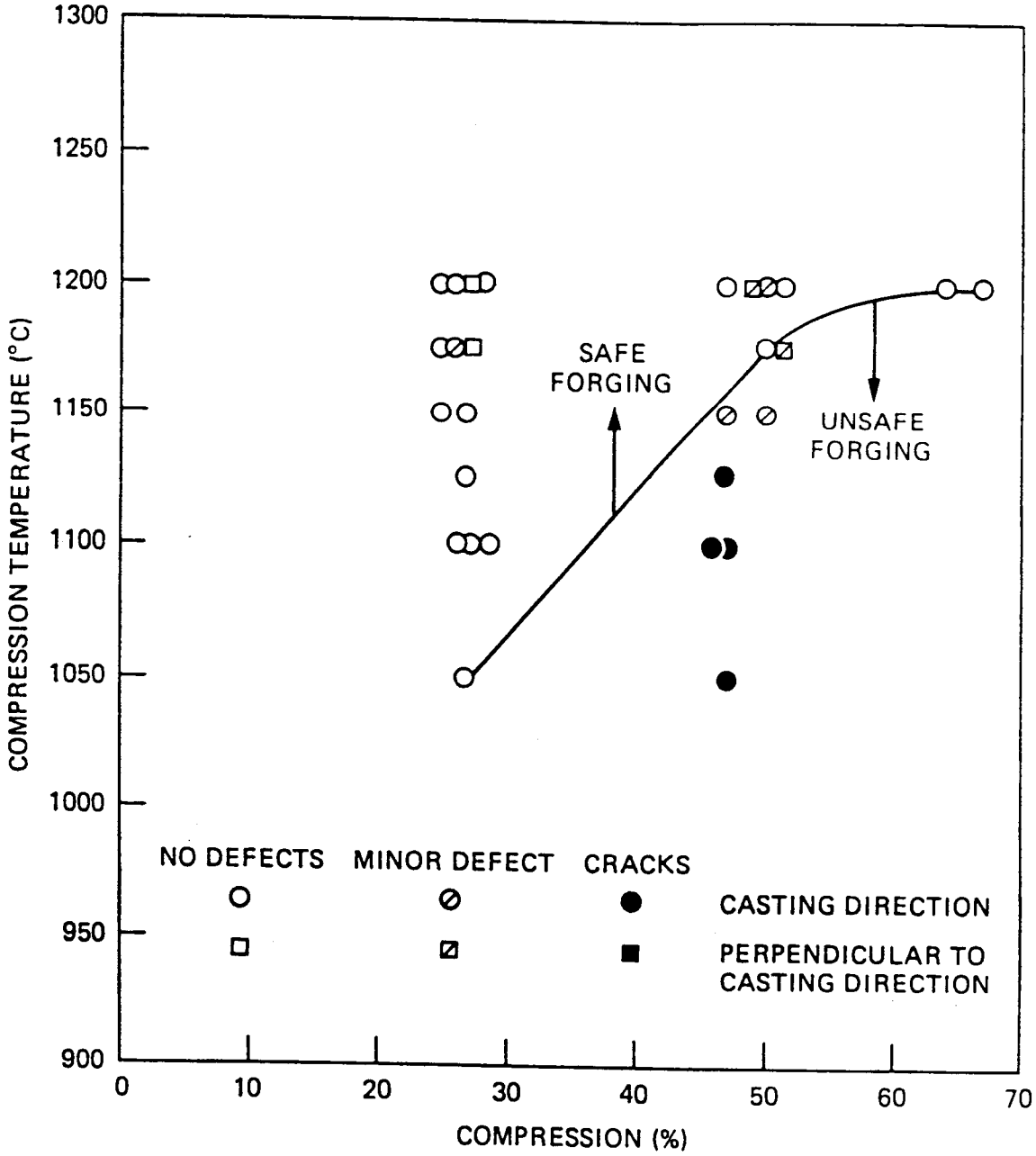
Figure 3:
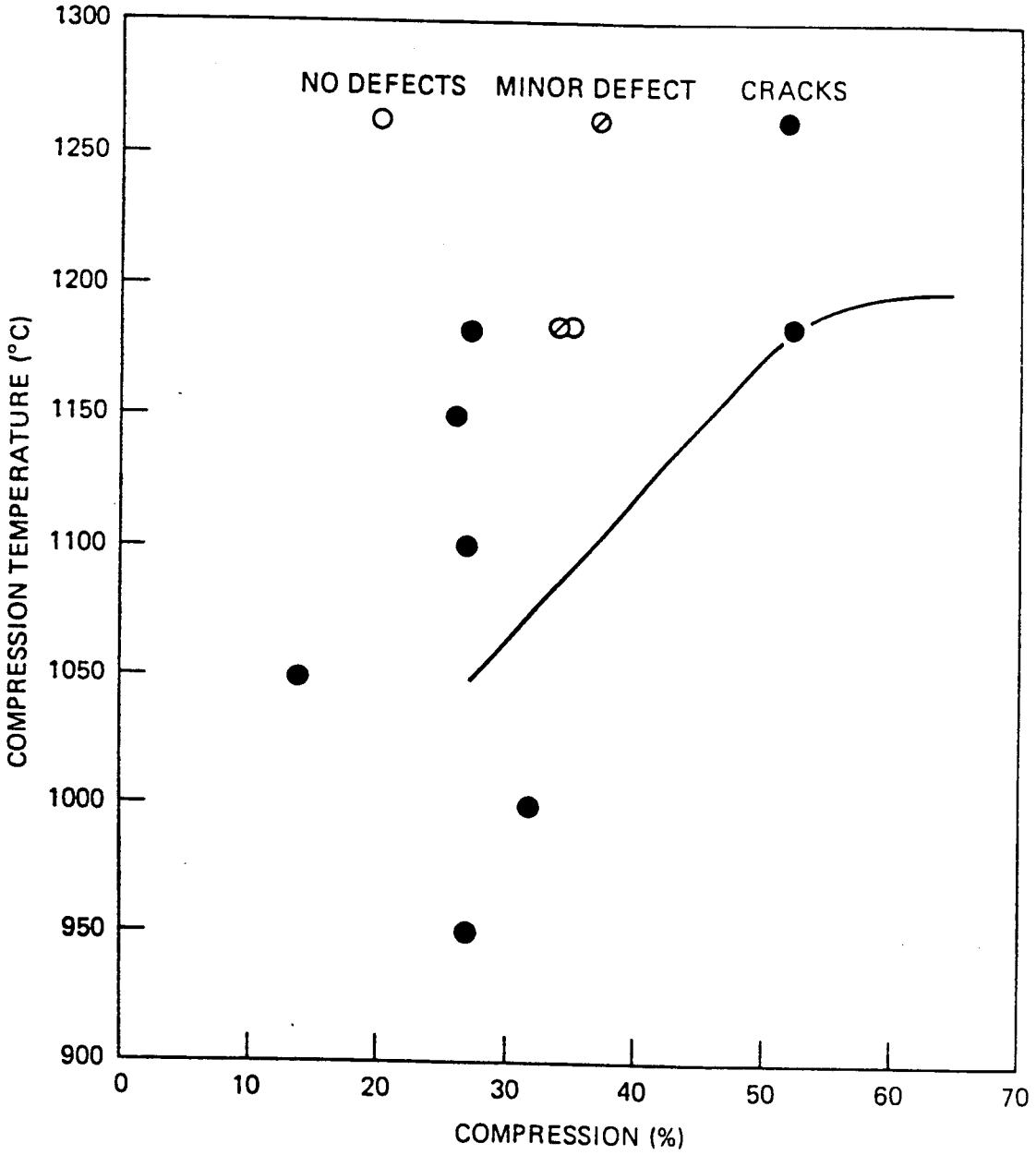

The foregoing and other features and advantages of the invention will be further described with reference to the following detailed description considered in conjunction with the accompanying drawings in which:

FIGS. 1*a* and 1*b* are photographic enlargements (800 × and 400 ×X, respectively) illustrating the microstructure of a prior art high zirconium content alloy (1 at. % zirconium) showing the effect of the heating rate above 1000° C. on the formation of undesirable zirconium-rich compositions at the grain interfaces;

FIG. 2 is a plot of compression versus temperature for nickel aluminide alloys containing zirconium in the range of the invention; and FIG. 3 is a plot of compression versus temperature for nickel aluminide alloys comparing hot compression results for alloys having a zirconium concentration within the range of the invention (represented by the curve) and alloys containing zirconium above the range of the invention (represented by the filled circles).

The compositions of the invention include nickel and aluminum to form a polycrystalline intermetallic $Ni_3Al$, chromium, zirconium, boron and in preferred forms titanium and carbon, wherein the zirconium concentration is maintained in the range of from about 0.05 to about 0.35 at. % in order to provide compositions exhibiting improved mechanical properties and improved fabricability at high temperatures in the neighborhood of 1200° C. without the occurrence of a significant degree of oxidation.

The invention stems from the discovery that prior art alloys containing relatively high amounts of zirconium in excess of about 0.4 at. % showed an indication of incipient melting within the microstructure during relatively rapid heating above 1150° C. This effect is illustrated in the photographic enlargements of FIGS. 1(*a*) and 1(*b*) comparing the microstructures of nickel aluminide alloys containing 1 at. % zirconium, with FIG. 1*a* showing the occurrence of incipient melting in the microstructure at a rapid heating rate of approximately 100° C. per 10 min. above 1000° C. and FIG. 1*b* showing a slow heating rate of about 100° C. per hour over 1000° C. where there is little if any incipient melting. The low-melting phase contains a high level of zirconium, probably a $Ni_5Zr$-type phase, and is believed to be responsible for the poor hot fabricability and low ductility of the alloy at high temperatures in the neighborhood of 1200° C. While the low-melting phase is metastable in nature and can be suppressed by slow heating of the alloys above 1000° C., such a heating process is relatively inefficient and the degree of suppression is difficult to control.

In accordance with the invention it is found that the formation of a low-melting metastable zirconium-rich phase may be suppressed by maintaining the zirconium concentration in the range of from about 0.05 to about 0.35 at. % to thereby avoid the need for a slow heating process. Preferably, the zirconium is maintained within the range of from about 0.2 to about 0.3 at. % and the optimum zirconium concentration is believed to be about 0.25 at. percent.

The aluminum and chromium in the compositions of the invention are provided in the range of from about 15.5 to about 18.5 and from about 6 to about 10 at. %, respectively. The concentration of chromium affects the ductility of the alloys at room temperature and elevated temperatures as taught in the assignee's U.S. Pat. No. 4,731,221 entitled "Nickel Aluminicles and Nickel-Iron Aluminicles, for use in Oxidizing Environments", the disclosure of which is incorporated herein by reference. A high chromium concentration of 10% causes a decrease in room temperature ductility, while a low concentration of about 6% results in a low ductility at 760° C. The optimum concentration of chromium is about 8 at. percent. The aluminum concentration affects the amount of ordered phase in the nickel aluminide alloys, and the optimum level is about 17.1 at. percent.

The boron is included to improve the ductility of the alloy as disclosed in the assignee's U.S. Pat. No. 4,711,761, mentioned above, and in an amount ranging from about 0.08 to about 0.30 at. percent. The preferred concentration of boron is from about 0.08 to about 0.25 at. % and the optimum boron concentration is about 0.1 at. percent.

The compositions may be prepared by standard procedures to produce castings that exhibit good strength and ductility at 1200° C., and which are more readily fabricated into desired shapes by conventional high temperature processing techniques. Table 1 shows the tensile properties of the low zirconium alloys of the invention at temperatures up to 1200° C. relative to nickel aluminide compositions incorporating no zirconium and zirconium in excess of the range discovered to be useful herein for providing nickel aluminide alloys exhibiting improved properties. In Table 1, the base alloy IC-283 contains 17.1 at. % aluminum, 8 at. % chromium, 0.5 at. % zirconium, 0.1 at. % boron, and a balance of nickel. In the other alloys IC-324, IC-323, and IC-288 in which the zirconium concentration is decreased, the reduction in zirconium is made up by increasing the aluminum concentration a corresponding amount. The alloys are prepared and the tensile tests are conducted according to the procedures described in the assignee's above-mentioned U.S. Pat. No. 4,612,165. For the test results disclosed herein, all alloys are heated at a rate of 100° C. per 10 min. above 1,000° C.

TABLE 1

Effect of Zirconium Additions on Tensile Properties of Chromium-Modified Nickel Aluminides

| Alloy Number | Alloy Additions (at %) | Strength, MPa (ksi) Yield | Ultimate | Elongation (%) |
|---|---|---|---|---|
| | | Room Temperature | | |
| IC-283 | 0.5 Zr | 493 (71.5) | 1722 (250) | 36.1 |
| IC-324 | 0.3 Zr | 506 (73.4) | 1461 (212) | 33.1 |
| IC-323 | 0.2 Zr | 493 (71.5) | 1447 (210) | 24.1 |
| IC-288 | 0 Zr | 409 (59.3) | 1371 (199) | 35.5 |
| | | 760° C. | | |
| IC-283 | | 723 (105) | 896 (130) | 26.1 |
| IC-324 | | 687 (99.7) | 841 (122) | 27.1 |
| IC-323 | | 677 (98.3) | 800 (116) | 29.4 |
| IC-288 | | 493 (71.5) | 616 (89.4) | 21.4 |
| | | 850° C. | | |
| IC-283 | | 723 (105) | 785 (114) | 17.8 |
| IC-324 | | 644 (93.6) | 723 (105) | 15.1 |
| IC-323 | | 642 (93.2) | 744 (108) | 16.4 |
| IC-288 | | 451 (65.4) | 522 (75.7) | 13.2 |
| | | 1000° C. | | |
| IC-283 | | 388 (49.1) | 408 (59.2) | 16.1 |
| IC-324 | | 353 (51.2) | 400 (58.0) | 12.1 |
| IC-323 | | 336 (48.7) | 395 (57.4) | 14.6 |
| IC-288 | | 226 (32.8) | 260 (37.7) | 19.7 |
| | | 1200° C. | | |
| IC-283 | | 11.7 (1.7) | 12.4 (1.8) | 0.5 |
| IC-324 | | 66.8 (9.7) | 68.2 (9.9) | 31.2 |
| IC-323 | | 67.5 (9.8) | 68.9 (10.0) | 33.0 |
| IC-288 | | 45.5 (6.6) | 53.7 (7.8) | 55.8 |

From Table 1 it is seen that the compositions IC-324 and IC-323 including 0.2 and 0.3 at. % zirconium, respectively, exhibit yield strengths in excess of 60 MPa and a ductility above 30% at 1200° C. At the same high temperature, the alloy IC-283 containing 0.5 at. % zirconium has a much lower yield strength in the neighborhood of 12 MPa and a considerably lower ductility of 0.5 percent. These results indicate that the incipient melting found to occur in the prior art alloys at temperatures above 1100° C. may be avoided by holding the zirconium concentration in the range of from about 0.05 to about 0.35 at. percent, with a range of from about 0.2 to about 0.3 at. % being preferred.

The hot fabricability of the low zirconium alloys of the invention was determined on 4 inch diameter ingots which were electroslag melted. One inch diameter cylindrical compression samples having a length of 1.5 inches were electrodischarge machined from the ingots. Each cylinder was heated for 1 hour at the desired temperature and compressed in steps of 25% in a 500 ton forging press. After each step, the specimens were examined for surface defects. If the surface showed no defect, the specimens were reheated for an additional hour and an additional 25% reduction was taken. The results are shown in FIGS. 2 and 3 which compare the hot forging response of a low zirconium alloy of the invention with the hot forging response of a high zirconium alloy of the prior art. The particular low zirconium alloy of FIG. 2 includes 16.9 at. % aluminum, 0.2 at. % zirconium, 8 at. % chromium and a balance of nickel. FIG. 2 shows the curve above which safe forging is possible for the alloy containing 0.2 at. % zirconium. It is seen from FIG. 2 that billets of the low zirconium alloy should be forgeable over a range of 1150° to 1200° C. However, for large reductions greater than about 50%, the temperature should be maintained close to 1200° C.

The high zirconium alloy of FIG. 3 includes 16.7 at. % aluminum, 0.4 at. % zirconium, 8 at. % chromium, and the balance nickel. The results of compression tests on this alloy are also given for a range of temperatures to simulate forging response and the safe forging curve of FIG. 2 is reproduced in FIG. 3 for comparison. From FIG. 3, it is seen that compared to an alloy containing 0.2 at. % zirconium, there is no safe forging region possible for the high zirconium alloy containing 0.4 at. % zirconium.

Another common commercial process is hot extrusion. For comparison, the alloys of FIGS. 2 and 3 are extruded using stainless steel cans which are used to hold the extrusion temperature and to deform the alloy ingots under a hydrostatic compression. Both alloys are hot extrudable at 1100° C. However, through further experimentation it was determined that the low zirconium alloy may be extruded without the expensive stainless steel can. An improved surface finish for the low zirconium alloy during extrusion may also be obtained by wrapping a 20-mil-thick mild steel sheet around the billets and extruding at 1200° C.

The low zirconium alloys of the invention are also more amenable to hot rolling processes required for preparing the flat product from cast, forged or extruded material. For example, the low zirconium alloy of FIG. 2 containing 0.2 at. % zirconium was hot rollable in the cast condition with a stainless steel cover in the temperature range of 1100° to 1200° C. and was also easily hot rollable in the extruded condition in the same temperature range. However, the high zirconium alloy of FIG. 3 containing 0.4 at. % zirconium was not easily hot rollable in the as-cast condition, even with a cover. The extruded high zirconium alloy was hot rollable, but only over a narrow temperature range of 1125° to 1175° C.

The creep properties of the alloys of Table 1 were determined at 760° C. and 413 MPa (60 ksi) in air. The results are shown in Table 2.

TABLE 2

Creep Properties of Chromium-Modified Aluminides Tested at 760° C. and 413 MPa (60 ksi) in Air

| Alloy Number | Alloy Additions (at. %) | Rupture Life (h) | Rupture Ductility (%) |
|---|---|---|---|
| IC-283 | 0.5 Zr | 284 | 16.1 |
| IC-324 | 0.3 Zr | 87 | 24.5 |
| IC-323 | 0.2 Zr | 51 | 30.0 |
| IC-288 | 0 Zr | 2 | 16.2 |

It is seen from Table 2 that the rupture life of the alloys decreases with decreasing zirconium content, and that decreasing the zirconium content moderately increases the rupture ductility of the alloys (except at 0.0 at. % Zr).

In order to improve the mechanical properties of the low zirconium alloys of the invention and particularly the creep resistance, a series of alloys was prepared based on IC-324 (containing 0.3% zirconium) in which additions of up to 0.7 at. % titanium, niobium, rhenium, and silicon were made. Table 3 shows the tensile results of this series of alloys.

TABLE 3

Effect of Alloy Additions on Tensile Properties of Chromium-Modified Nickel Aluminides

| Alloy Number | Alloy Additions (at %) | Strength, MPa (ksi) Yield | Strength, MPa (ksi) Ultimate | Elongation (%) |
|---|---|---|---|---|
| | | Room Temperature | | |
| IC-326 | 0.3 Zr + 0.2 Ti | 531 (77.0) | 1481 (215) | 32.4 |
| IC-328 | 0.2 Zr + 0.3 Ti | 520 (75.4) | 1426 (207) | 31.3 |
| IC-343 | 0.3 Zr + 0.7 Ti | 593 (86.1) | 1536 (223) | 30.0 |
| IC-358 | 0.3 Zr + 0.2 Nb | 430 (62.4) | 1357 (197) | 35.8 |
| IC-359 | 0.3 Zr + 0.4 Nb | 524 (76.1) | 1403 (204) | 30.8 |
| IC-360 | 0.3 Zr + 0.2 Re | 548 (79.5) | 1506 (219) | 29.3 |
| IC-361 | 0.3 Zr + 0.4 Re | 575 (83.4) | 1315 (191) | 21.2 |
| IC-362 | 0.3 Zr + 0.2 Si | 424 (61.5) | 1280 (186) | 31.9 |
| IC-363 | 0.3 Zr + 0.4 Si | 484 (70.2) | 1206 (175) | 23.4 |
| | | 760° C. | | |
| IC-326 | | 730 (106) | 868 (126) | 28.6 |
| IC-328 | | 717 (104) | 847 (123) | 28.1 |
| IC-343 | | 806 (117) | 944 (137) | 24.3 |
| IC-358 | | 647 (93.9) | 764 (111) | 29.6 |
| IC-359 | | 672 (97.6) | 816 (119) | 24.1 |
| IC-360 | | 755 (110) | 900 (131) | 26.1 |
| IC-361 | | 759 (110) | 885 (128) | 23.2 |
| IC-362 | | 582 (84.5) | 741 (108) | 24.6 |
| IC-363 | | 699 (102) | 849 (123) | 29.0 |
| | | 850° C. | | |
| IC-326 | | 717 (104) | 799 (116) | 17.9 |
| IC-328 | | 684 (99.3) | 758 (110) | 21.0 |
| IC-343 | | 744 (108) | 847 (123) | 15.6 |
| IC-358 | | 587 (85.2) | 666 (96.7) | 17.9 |
| IC-359 | | 649 (94.3) | 725 (105) | 18.2 |
| IC-360 | | 735 (107) | 818 (119) | 17.2 |
| IC-361 | | 706 (102) | 788 (114) | 15.5 |
| IC-362 | | 605 (87.8) | 700 (102) | 19.8 |
| IC-363 | | 666 (96.7) | 755 (110) | 16.1 |
| | | 1000° C. | | |
| IC-326 | | 329 (47.7) | 400 (58.0) | 20.5 |
| IC-328 | | 309 (44.9) | 387 (55.4) | 18.8 |
| IC-343 | | 436 (63.3) | 497 (72.2) | 8.8 |
| IC-358 | | 321 (46.6) | 348 (50.4) | 15.9 |
| IC-359 | | 333 (48.3) | 375 (54.7) | 17.5 |
| IC-360 | | 393 (57.0) | 435 (63.2) | 18.4 |
| IC-361 | | 364 (52.8) | 404 (58.6) | 13.9 |
| IC-362 | | 335 (48.6) | 364 (52.8) | 15.7 |
| IC-363 | | 358 (52.0) | 392 (56.9) | 18.0 |
| | | 1200° C. | | |
| IC-326 | | 71.7 (10.4) | 88.9 (12.9) | 29.6 |
| IC-328 | | 68.2 (9.9) | 79.9 (11.6) | 29.3 |
| IC-343 | | 62.7 (9.1) | 69.6 (10.1) | 18.9 |
| IC-358 | | 62.7 (9.1) | 68.2 (9.9) | 50.7 |
| IC-359 | | 71.0 (10.3) | 77.9 (11.3) | 42.1 |
| IC-360 | | 66.8 (9.7) | 68.2 (9.9) | 56.6 |
| IC-361 | | 74.4 (10.8) | 82.0 (11.9) | 47.1 |
| IC-362 | | 75.1 (10.9) | 77.2 (11.2) | 49.9 |
| IC-363 | | 64.8 (9.4) | 70.3 (10.2) | 50.3 |

Comparing the results shown in Table 3 with those of Table 1 it is seen that among the alloy additions, rhenium is the most effective strengthener followed by titanium and niobium. Also, the tensile properties at 1000° and 1200° C. are not particularly sensitive to alloy additions. Moreover, the ductility of the alloys is basically unaffected by alloy additions except that alloying with 0.4% silicon and rhenium moderately lowers the room-temperature ductility and alloying with 0.7 at. % titanium lowers the ductilities at 1000° and 1200° C.

The creep properties of the aluminides with the alloying additions are shown in Table 4. The creep properties of the base alloy IC-324 from Table 2 are reproduced in Table 4 for ease of comparison.

TABLE 4

Creep Properties of Chromium-Modified Aluminides Tested at 760° C. and 413 MPa (60 ksi) in Air

| Alloy Number | Alloy Additions (at. %) | Rupture Life (h) | Rupture Ductility (%) |
|---|---|---|---|
| IC-324 | 0.3 Zr | 87 | 24.5 |
| IC-326 | 0.3 Zr + 0.2 Ti | 130 | 21.4 |
| IC-328 | 0.2 Zr + 0.3 Ti | 70 | 25.0 |
| IC-343 | 0.3 Zr + 0.7 Ti | 79 | 20.6 |
| IC-358 | 0.3 Zr + 0.2 Nb | 52 | — |
| IC-359 | 0.3 Zr + 0.4 Nb | 84 | 29.2 |
| IC-360 | 0.3 Zr + 0.2 Re | 53 | 31.7 |
| IC-361 | 0.3 Zr + 0.4 Re | 70 | 25.1 |
| IC-362 | 0.3 Zr + 0.2 Si | 64 | 28.5 |
| IC-363 | 0.3 Zr + 0.4 Si | 101 | 30.4 |

Table 4 shows that alloying with 0.2 at. % titanium (IC-326) significantly increases the creep resistance of the base alloy IC-324 containing 0.3 at. % zirconium. The addition of about 0.4 at. % silicon also increases the creep resistance. Alloying with 0.2 at. % niobium and rhenium lowers the creep resistance. Also, it is to be noted from Table 4 that alloying with 0.7 at. % titanium does not improve the creep resistance of the base alloy.

As shown in Table 5 below, further additions of 0.5 at. % titanium, molybdenum and niobium moderately increases the strength of the alloy IC-326 (containing 0.3 at. % zirconium and 0.2 at. % titanium) at temperatures up to about 1000° C. The alloying additions reduce the strength of the alloy at 1200° C. The creep resistance of IC-326 is not further improved by adding 0.5 at. % titanium, molybdenum or niobium.

TABLE 5

Effect of Alloy Addition on Creep Properties of IC-326 (0.3 at. % Zr)

| Alloy Number | Alloy Additions (at. %) | Rupture Life (h) | Rupture Ductility (%) |
|---|---|---|---|
| IC-326 | None | 130 | 21.4 |
| IC-343 | 0.5 Ti | 79 | 20.6 |
| IC-345 | 0.5 Mo | 85 | 16.4 |
| IC-346 | 0.5 Nb | 112 | 16.2 |

From the results disclosed herein the alloy IC-326 appears to exhibit the best combination of creep and tensile properties. The alloy has good cold fabricability and its hot fabricability can be further improved by cold forging followed by recrystallization annealing at 1000° to 1100° C. to break down the cast structure and refine the grain structure of the alloy. The hot fabricability of IC-326 is not sensitive to alloying additions of titanium, niobium, rhenium, silicon or molybdenum.

The addition of up to about 0.5 at. % (0.1 wt. %) carbon further improves the hot fabricability of IC-326. The beneficial affect of carbon comes from refinement of cast grain structure through precipitation of carbides during solidification.

Table 6 shows the tensile properties of alloys containing 0.3 at. % zirconium together with an amount of from about 0.2 to about 0.5 at. % titanium, and 0.1 wt. % carbon. Table 6 also includes the tensile properties of the base alloy IC-326 from Table 3.

TABLE 6

Tensile Properties of Nickel Aluminides Added with 0.1 wt. % C.

| Alloy Number | Alloy Additions (at %) | Strength, MPa (ksi) Yield | Strength, MPa (ksi) Ultimate | Elongation (%) |
|---|---|---|---|---|
| | | Room Temperature | | |
| IC-326* | 0.3 Zr + 0.2 Ti | 531 (77.0) | 1481 (215) | 32.4 |
| IC-373** | 0.3 Zr + 0.2 Ti | 454 (65.9) | 1543 (224) | 41.3 |
| IC-374** | 0.3 Zr + 0.5 Ti | 519 (75.3) | 1378 (200) | 28.3 |
| | | 760° C. | | |
| IC-326 | | 730 (106) | 868 (126) | 28.6 |
| IC-373 | | 619 (88.8) | 813 (118) | 16.0 |
| IC-374 | | 683 (99.2) | 827 (120) | 16.4 |
| | | 850° C. | | |
| IC-326 | | 717 (104) | 799 (116) | 17.9 |
| IC-373 | | 588 (85.4) | 702 (102) | 26.5 |
| IC-374 | | 613 (88.9) | 723 (105) | 22.6 |
| | | 1000° C. | | |
| IC-326 | | 529 (47.7) | 400 (58.0) | 20.5 |
| IC-373 | | 336 (48.8) | 369 (53.6) | 19.0 |
| IC-374 | | 276 (40.0) | 305 (44.3) | 22.7 |
| | | 1200° C. | | |
| IC-326 | | 71.7 (10.4) | 85.4 (12.4) | 29.6 |
| IC-373 | | 51.7 (7.5) | 135 (19.6) | 54.2 |
| IC-374 | | 32.4 (4.7) | 43.4 (6.3) | 11.4 |

*Base composition.
**0.1 wt. % C.

The results of Table 6 show that the addition of 0.1 at. % carbon moderately reduces the strengths at all testing temperatures. However, the carbon addition substantially increases the ductility at 1200° C. to thereby improve the hot fabricability of the alloy.

It is thus seen that the low zirconium nickel aluminides of the present invention exhibit improved mechanical properties at high temperatures in the neighborhood of 1200° C. and are more readily fabricated into desired shapes using conventional hot processing techniques when compared with previous compositions. The addition of small amounts of other elements such as titanium and carbon further improve the mechanical properties and fabricability of the alloys of the invention at high temperatures.

Although preferred embodiments of the invention have been illustrated and described in the foregoing detailed description, it will be understood by those of ordinary skill in the art that the invention is capable of numerous modifications, substitutions, replacements and rearrangements without departing from the scope and spirit of the claims appended hereto.

What is claimed is:

1. A nickel aluminide alloy composition suitable for fabrication at high temperature in the range of about 1050° to about 1200° C. consisting essentially of: a $Ni_3Al$ base; a sufficient concentration of chromium to increase ductility at elevated temperatures in oxidizing environments; a sufficient concentration of boron to increase ductility; about 0.2 to about 0.5% titanium to improve the creep resistance; and a sufficient concentration of zirconium to provide high strength and good alloy fabricability at a temperature in the range of about 1050° C. to about 1200° C.

2. The composition of claim 1 wherein the concentration of zirconium is less than about 0.3 percent.

3. The composition of claim 1 wherein the concentration of aluminum is about 17.1%, the concentration of chromium is about 8%, the concentration of zirconium is about 0.25%, and the concentration of boron is about 0.1 percent.

4. The composition of claim 2, 3, or 1 further comprising from about 0.01 to about 0.5% carbon.

5. A nickel aluminide composition consisting essentially of nickel and, in atomic percent, from about 15.5 to about 18.5% aluminum, from about 6 to about 10% chromium, from about 0.1 to about 0.35% zirconium, from about 02. to about 0.5% titanium and from about 0.08 to about 0.30% boron.

6. The composition of claim 5 wherein the zirconium is provided in an amount equal to from about 0.2 to about 0.3 percent.

7. A nickel aluminide composition consisting essentially of 17.1 at. % aluminum, 8 at. % chromium, 0.25 at. % zirconium, 0.25 at. % titanium, 0.1 at. % boron, from about 0.01 to about 0.5 at. % carbon, and the balance nickel.

8. The method of improving the fabricability and strength of a nickel aluminide composition in the temperature range of about 1050° C. to about 1200° C., said composition consisting essentially of nickel and from about 15.5 to about 18.5 at. % aluminum, from about 6 to about 10 at. % chromium, from about 0.08 to about 0.3 at. % boron, from about 0.2 to about 0.5 at. % titanium, and an amount of zirconium which comprises maintaining said amount of zirconium within the range of from about 0.05 at. % to about 0.35 at. percent.

9. The method according to claim 8 wherein the zirconium concentration is maintained below about 0.3 percent.

10. The composition of claim 6 further comprising from about 0.01 to about 0.5% carbon.

11. The composition of claim 1 wherein the concentration of zirconium is in the range from about 0.05 at. % to about 0.35 at. percent.

12. A nickel aluminide alloy composition suitable for fabrication at high temperature in the range of about 1050° to about 1200° C. consisting essentially of: a $Ni_3Al$ base; a sufficient concentration of chromium to increase ductility at elevated temperatures in oxidizing environments; a sufficient concentration of boron to increase ductility; and a concentration of zirconium of less than about 0.2 at. percent to provide high strength and good alloy fabricability at a temperature in the range of about 1050° C. to about 1200° C.

13. The method of improving the fabricability and strength of a nickel aluminide composition in the temperature range of about 1050° C. to about 1200° C., said composition consisting essentially of nickel and from about 15.5 to about 18.5 at. % aluminum, from about 6 to about 10 at. % chromium, from about 0.08 to about 0.3 at. % boron, and an amount of zirconium which comprises maintaining said amount of zirconium below about 0.2 at. percent.

14. A nickel aluminide alloy composition suitable for fabrication at high temperatures int he range of about 1050° C. to about 1200° C. consisting essentially of nickel and from about 15 to about 18.5 at. % aluminum, from about 6 to about 10 at. % chromium, from about 0.08 to about 0.30 at. percent boron, and a zirconium concentration less than about 0.2 at. % to provide the alloy with strength and fabricability at a temperature in the range of about 1050° C. to about 1200° C.

15. A nickel aluminide alloy composition suitable for fabrication at high temperatures in the range of about 1050° C. to about 1200° C. consisting essentially of nickel and from about 15 to about 18.5 at. % aluminum, from about 6 to about 10 at. % chromium, from about 0.08 to about 0.30 at. % boron, from about 0.2 at. % to about 0.5 at. % titanium, and an amount of zirconium sufficient provide the alloy with strength and fabricability at a temperature in the range of about 1050° C. to about 1200° C.

16. A nickel aluminide alloy composition suitable for fabrication at high temperatures in the range of about 1050° C. to about 1200° C. consisting essentially of nickel and from about 15 at. % to about 18.5 at. % aluminum, from about 6 at. % to about 10 at. % chromium, from about 0.08 at. % to about 0.30 at. % boron, and from about 0.05 at. % up to less than about 0.2 at. % zirconium.

17. The composition of claim 16 further comprising from about 0.2 at. % to about 0.5 at. % titanium.

* * * * *